US007556402B2

(12) United States Patent
Garrett et al.

(10) Patent No.: US 7,556,402 B2
(45) Date of Patent: Jul. 7, 2009

(54) DIRECT-INDIRECT LUMINAIRE WITH SHUTTER

(75) Inventors: Bradley Stephen Garrett, Denver, CO (US); Christopher Joseph Pahl, Denver, CO (US)

(73) Assignee: Cooper Technologies Company, Houston, TX (US)

( * ) Notice: Subject to any disclaimer, the term of this patent is extended or adjusted under 35 U.S.C. 154(b) by 33 days.

(21) Appl. No.: 11/095,083

(22) Filed: Mar. 29, 2005
(Under 37 CFR 1.47)

(65) Prior Publication Data

US 2005/0231952 A1 Oct. 20, 2005

Related U.S. Application Data

(60) Provisional application No. 60/557,505, filed on Mar. 29, 2004.

(51) Int. Cl.
*F21V 14/08* (2006.01)

(52) U.S. Cl. ..... 362/279; 362/307

(58) Field of Classification Search ..... 362/279, 362/290, 304, 277–278, 281–283, 342, 344, 362/346; 40/579
See application file for complete search history.

(56) References Cited

U.S. PATENT DOCUMENTS 2,322,734 A * 6/1943 Steiner ..... 396/485
3,284,951 A * 11/1966 Shapiro ..... 49/74.1
4,074,124 A 2/1978 Maute et al.
4,173,034 A 10/1979 Shemitz
4,210,955 A 7/1980 Labrum
4,222,094 A 9/1980 Wolar
4,257,086 A 3/1981 Gulliksen
4,314,320 A 2/1982 Wolar
4,323,955 A 4/1982 Mark
4,468,720 A 8/1984 Arai
4,499,529 A * 2/1985 Figueroa ..... 362/283
4,530,041 A 7/1985 Yamai et al.
4,800,473 A 1/1989 Tremblay
5,014,172 A 5/1991 Burn et al.
5,067,064 A 11/1991 Gehly et al.
5,077,649 A 12/1991 Jackel et al.
5,165,787 A 11/1992 Holzhacker
5,276,601 A 1/1994 Holzhacker
5,293,306 A 3/1994 Bamber
5,313,380 A 5/1994 Weigert
5,510,965 A 4/1996 Teakell
5,510,969 A 4/1996 Rodger et al.

(Continued)

*Primary Examiner*—Jong-Suk (James) Lee
*Assistant Examiner*—Julie A Shallenberger
(74) *Attorney, Agent, or Firm*—King & Spalding LLP

(57) ABSTRACT

A direct-indirect luminaire including a pair of sockets for receiving at least one tubular fluorescent lamp; a louver, arranged on one side of the lamp socket, for controlling downlight from the lamp; and a shutter, arranged on an opposite side of the lamp socket, for controlling uplight from the lamp. The shutter may include a plurality of adjustably sizeable apertures which may be formed by adjacent members that are slidable relative to each other, with matching patterns of overlapping openings. The adjacent members may further include nested concave surfaces facing the lamp, such as channel-shaped members with openings that are arranged on at least two walls of the channel. A positioner may also be provided for designating a size of the apertures. For example, the positioner may include a protuberance on one of the adjacent members for engaging a hole in the other of the adjacent members.

23 Claims, 6 Drawing Sheets

U.S. PATENT DOCUMENTS 5,590,954 A 1/1997 Hanson et al.
5,733,036 A * 3/1998 Montgomery ..... 362/283
5,806,967 A 9/1998 Soorus et al.
5,884,994 A * 3/1999 Herst et al. ..... 362/256
5,887,970 A 3/1999 Payne
5,904,417 A 5/1999 Hewett
5,908,234 A * 6/1999 Kreeft ..... 362/223
6,076,943 A 6/2000 Lassovsky
6,102,554 A 8/2000 Wynne Wilson et al.
6,161,939 A * 12/2000 Bansbach ..... 362/223
6,168,291 B1 1/2001 Rockey et al.
6,206,548 B1 3/2001 Lassovsky
6,241,366 B1 6/2001 Roman et al.
6,249,092 B1 6/2001 Kanatani
6,536,922 B1 3/2003 Hewlett et al.
6,550,939 B2 4/2003 Reinert
6,561,678 B2 5/2003 Loughrey
2002/0089852 A1* 7/2002 Casciani et al. ..... 362/290
2002/0167809 A1* 11/2002 Glass ..... 362/290
2003/0099107 A1* 5/2003 Hess ..... 362/290

* cited by examiner

DIRECT-INDIRECT LUMINAIRE WITH SHUTTER

CROSS-REFERENCE TO RELATED APPLICATIONS

This present application claims priority to U.S. provisional Patent Application Ser. No. 60/557,505, filed on Mar. 29, 2004 which is incorporated by reference here in its entirety.

TECHNICAL FIELD

The technology disclosed generally relates to illumination with a light source (or support therefore) and modifier of the shutter type.

BACKGROUND

The "INESA Lighting Handbook" published by the Illuminating Engineering Society of North America, is incorporated by reference here in its entirety. As discussed in chapter seven of that handbook, a "luminaire" is a device for producing, controlling, and distributing light. It is typically a complete lighting unit consisting of one or more lamps, sockets for positioning and protecting the lamps and for connecting the lamps to a supply of electric power, optical devices for distributing the light, and mechanical components for supporting or attaching the luminaire. Luminaires are also sometimes referred to as "light fixtures."

"Diffused lighting" luminaires generally provide light on a work plane or an object that is not incident predominantly from any particular direction. "Direct-Indirect lighting" is a variant of general diffused lighting in which luminaires emit little or no light at angles near the horizontal. For example, Cooper Lighting of Peachtree City, Ga. offers a variety of suspended direct-indirect fluorescent luminaires under its Corelite brand which are well suited for open offices, private offices, conference rooms, trading floors, reception area, and educational facilities. Specification sheets and installation instructions for those luminaires are available at www.cooperlighting.com and are incorporated by reference here.

Shutters have also been used to control light eminating from a luminaire and are typically moveable covers or screens that alternately prevent or permit the passage of light. For example, U.S. Pat. No. 5,293,306 is incorporated by reference here and discloses a lantern with a shutter that can be closed in order to prevent light from shining through one side of the lantern. U.S. Pat. No. 4,530,041 is also incorporated by reference here and discloses a signal lamp with a slit-plate that is slidably positioned across the opening of a lamp housing in order to control light from the lamp. A variety of other lighting control techniques are also disclosed in U.S. Pat. Nos. 5,313,380, 4,468,720, 4,499,529, 6,206,581, 4,323,955, and 5,733,036, each of which is incorporated by reference here in its entirety.

SUMMARY

The technology disclosed here generally relates to direct-indirect luminaires including a pair of sockets for receiving at least one tubular fluorescent lamp; a louver, arranged on one side of the lamp socket, for controlling downlight from the lamp; and a shutter, arranged on an opposite side of the lamp socket, for controlling uplight from the lamp. For example, the shutter may include a plurality of adjustably sizeable apertures which may be formed by adjacent members that are slidable relative to each other, with matching patterns of overlapping openings. The adjacent members may further include nested concave surfaces facing the lamp, such as channel-shaped members with openings that are arranged on at least two walls of the channel. A positioner may also be provided for designating a size of the apertures. For example, the positioner may include a protuberance on one of the adjacent members for engaging a hole in the other of the adjacent members.

In another embodiment, the technology disclosed here relates to a direct-indirect lighting system including a lamp; a baffle, such as a louver grid, arranged on one side of the lamp; and a shutter arranged on another side of the lamp. For example, the shutter may include a plurality of adjustably sizeable apertures which may be formed by adjacent members that are slidable relative to each other, with matching patterns of overlapping openings. The adjacent members may further include nested concave surfaces facing the lamp, such as channel-shaped members with openings that are arranged on at least two walls of the channel. A positioner may also be provided for designating a size of the apertures. For example, the positioner may include a protuberance on one of the adjacent members for engaging a hole in the other of the adjacent members.

In yet another embodiment, the technology disclosed here relates to a direct-indirect luminaire including means for receiving at least one tubular fluorescent lamp; means, arranged on one side of the lamp socket, for controlling downlight from the lamp; and means, arranged on an opposite side of the lamp socket, for controlling uplight from the lamp. For example, the means for controlling uplight may include a plurality of adjustably sizeable apertures which may be formed by adjacent members that are slidable relative to each other, with matching patterns of overlapping openings. The adjacent members may further include nested concave surfaces facing the lamp, such as channel-shaped members with openings that are arranged on at least two walls of the channel. Means for designating a size of the apertures may also be provided and may include a protuberance on one of the adjacent members for engaging a hole in the other of the adjacent members.

BRIEF DESCRIPTION OF THE DRAWINGS

Various aspects of this technology will now be described with reference to the following figures ("FIGS.") in which the same reference numerals are used to designate corresponding parts throughout each of the several views.

DETAILED DESCRIPTION OF THE PREFERRED EMBODIMENTS

Figure 1:
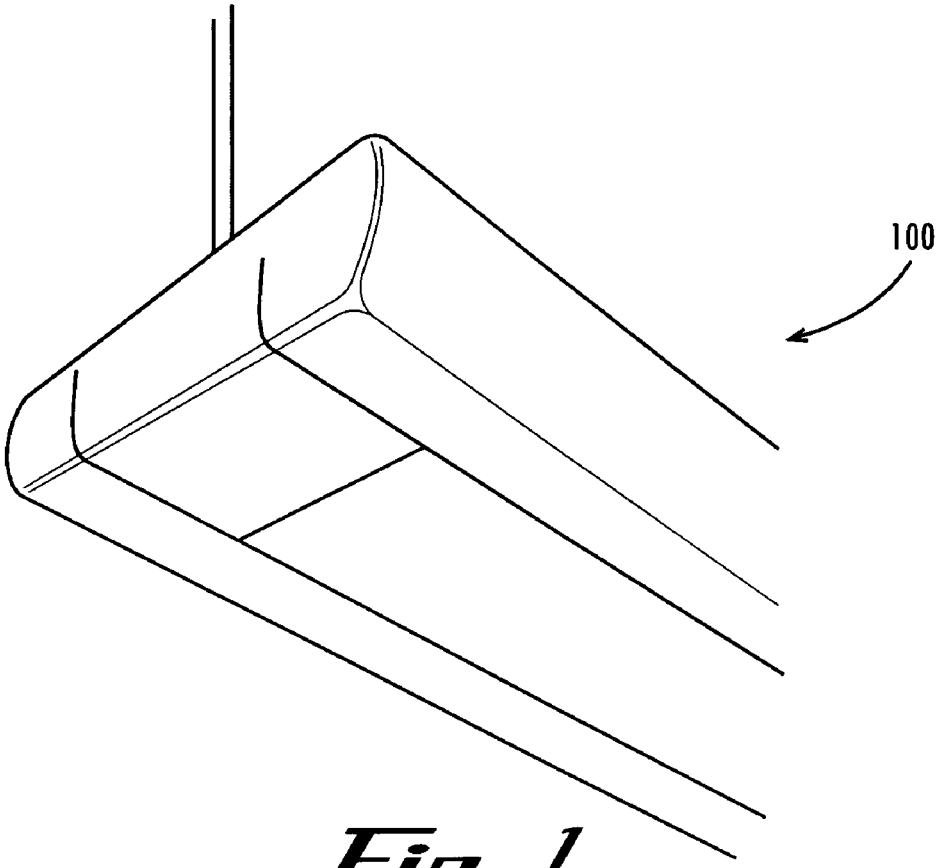
FIG. 1 is a bottom, partial isometric view of one embodiment of a direct-indirect luminaire.
Figure 2:
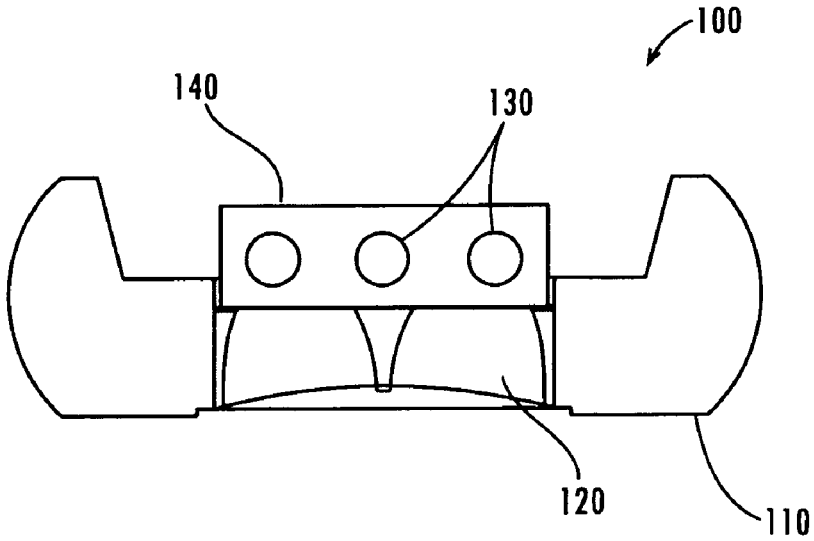
FIG. 2 is a schematic vertical section view of the luminaire in FIG. 1.

FIG. 1 is a bottom, partial isometric view of one embodiment of a direct-indirect fluorescent luminaire 100 while FIG. 2 is a vertical schematic section view of the luminaire 100 shown in FIG. 1.

FIG. 2 illustrates the luminaire 100 including a body 110 for supporting a louver 120, lamps 130, and a shutter assembly 140. The louver 120 is one of many types of baffles and/or other devices that may be used in order to control the light eminating downward from the luminaire 110. Although three lamps 130 are shown in the drawings, any number of lamps may also be used. Furthermore, although the drawings illustrate tubular fluorescent lamps, any other type of non-fluorescent and/or non-tubular lamps may also be used.

Figure 3:
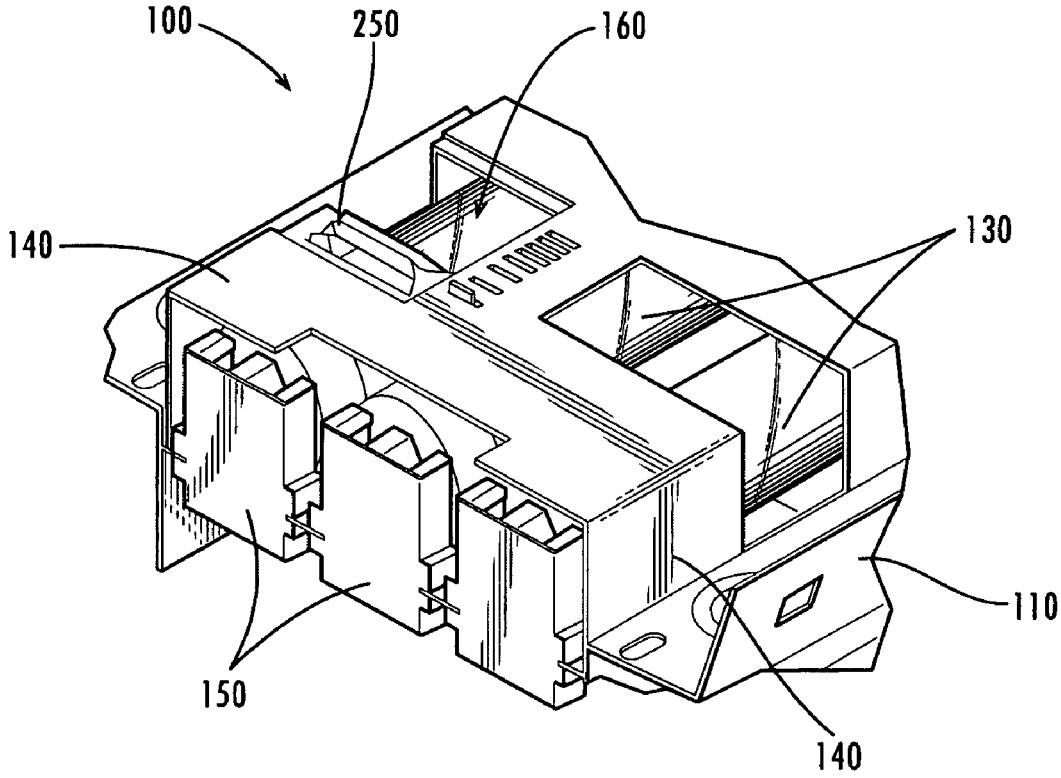
FIG. 3 is a partial top view of the shutter assembly shown in FIG. 2.
Figure 4:
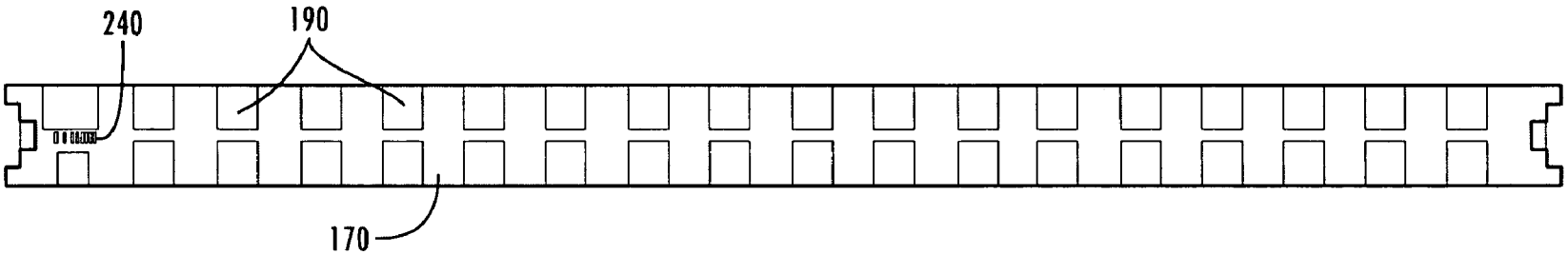
FIG. 4 is a top view of a first member of the shutter assembly shown in FIGS. 2 and 3.
Figure 5:
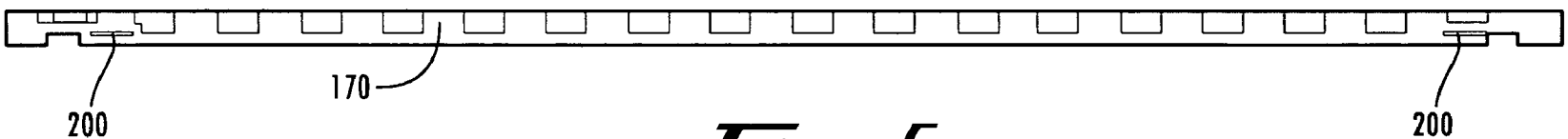
FIG. 5 is a side view of the first member of the shutter assembly shown in FIG. 4.
Figure 6:
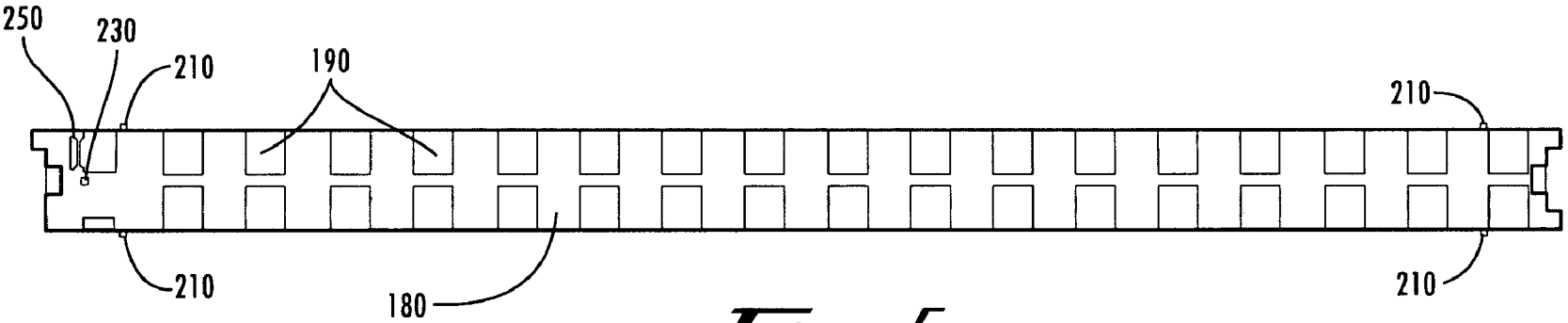
FIG. 6 is a top view of a second member of the shutter assembly shown in FIGS. 2 and 3.
Figure 7:
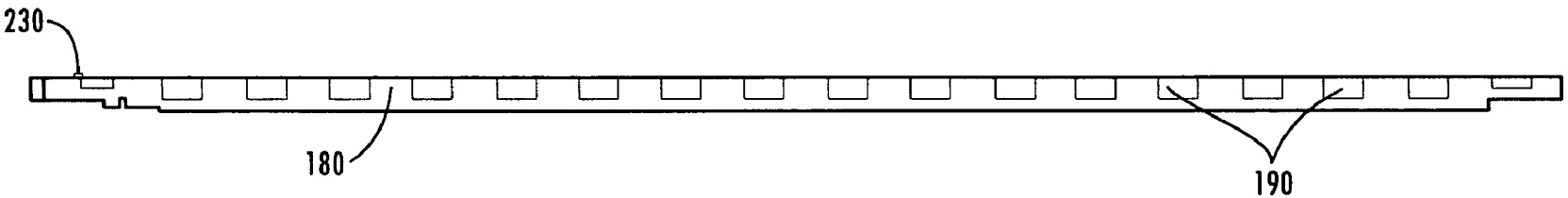
FIG. 7 is a side view of the second member of the shutter assembly shown in FIG. 6.

FIG. 3 is an enlarged partial isometric view of the shutter assembly 140 in the body 110. Sockets 150 are provided at each end of the luminaire 100 for receiving the ends of the lamps 130. The shutter assembly is arranged over the lamps 130 and the lamp sockets 150 for controlling uplight from the lamps. The louver, or other baffle, 120 is arranged on the opposite side of the lamps 130 and lamp sockets 150 for controlling down light from the lamps and preventing glare.

The shutter assembly 140 includes one or more adjustably sized apertures 160. These apertures 160 allow the amount of uplight to be controlled. For example, as illustrated in FIGS. 4-7, the apertures 160 in the shutter assembly 140 may be provided by a first C-shaped channel member 170 which is nested over a second C-shaped channel member 180.

Each of the C-shaped channel members 170 and 180 includes one or more openings 190 which may be arranged on one, two, and/or three sides of the member. The openings 190 are preferably arranged in matching and/or overlapping patterns so that when the first member 170 is nested over the second member 180, and the members are slid length-wise relative to each other, the openings 190 will overlap in order to shrink the size of the apertures 160 as shown in FIG. 8.

In order to keep the first member 170 nested with the second member 180, the members may be provided with a guide slot 200 for engaging a guide post 210. These configuration helps the first and second members 170, 180 from being slid entirely apart. Although the drawings illustrate the guide slot 200 formed in the first member 170 and the guide post 210 formed in the second member 180, the positions of the slot and cam may be reversed. In addition, the guide post 210 may be arranged to extend inward, rather than outward as shown in the drawings.

Figure 8:
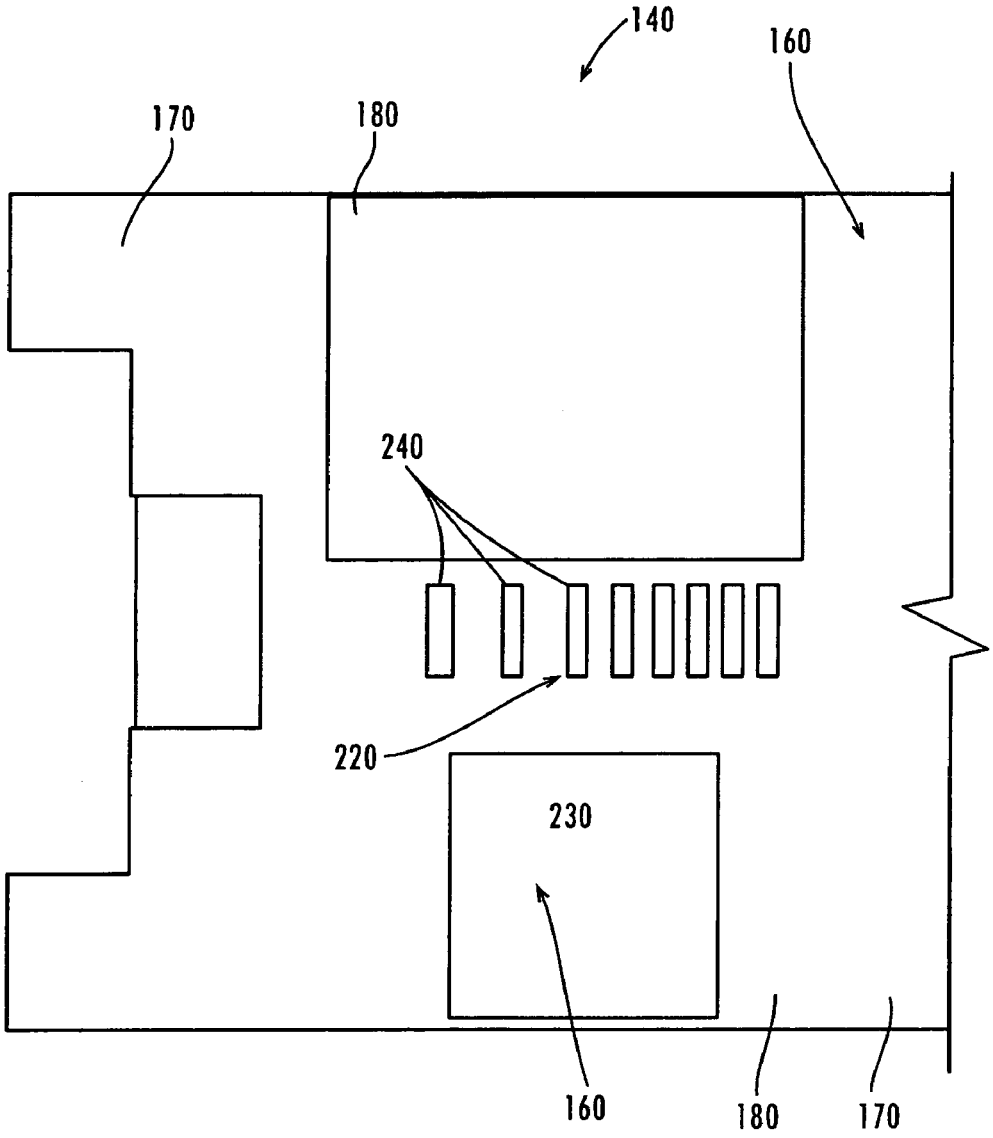
FIG. 8 is a top view of the shutter assembly in a partially open position.

As best shown in FIG. 8, the shutter assembly 140 may also be provided with a positioner 220 for designating the size of the apertures. For example, the positioner 220 may include a protuberance 230 extending from one of the first member 170 and second member 180 for engaging one or more holes 240 in the other of the first and second members. In this way, incremental sizes for the apertures 160 can be correlated with the spacing between the positioner holes 240.

The shutter assembly 140 may therefore be sent to the customer with a specified optical setting. In order to change that setting in the field, an installer would merely depress the protuberance 230 and slide the first member 170 relative to the second member 180. In this regard, a tab 250 may be provided on one, or both, of the first and second members 170 and 180. For the embodiment illustrated in the drawings, the tab 250 is provided on the second member 180 and the first member 170 is secured to the body 110 of the luminaire 100. However, other arrangements may also be used.

Figure 9:
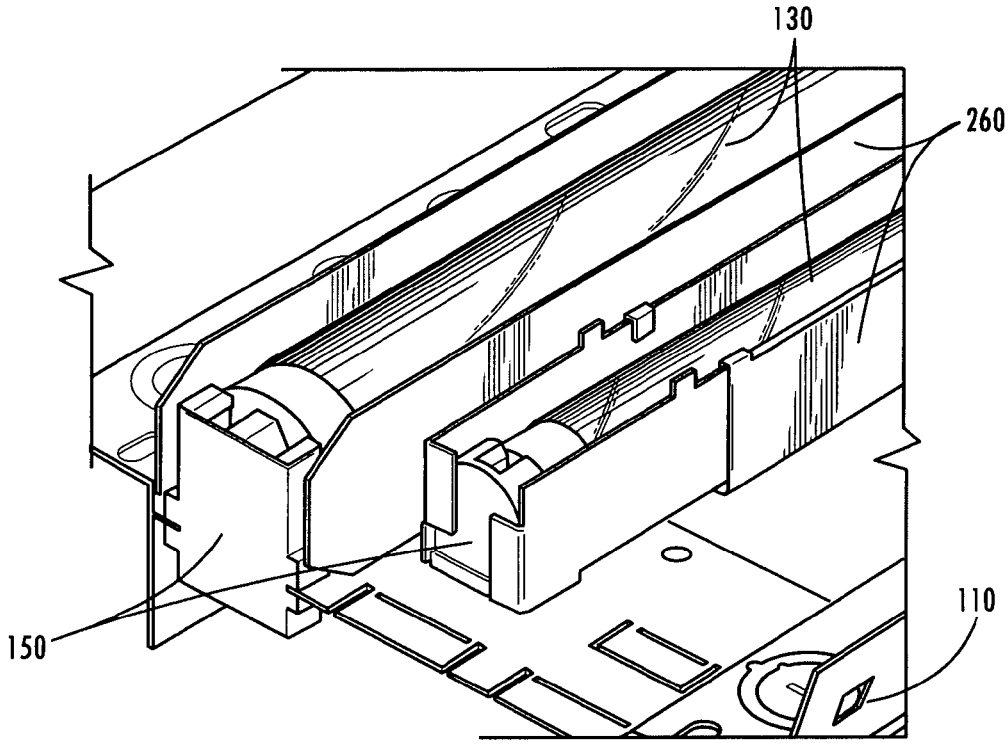
FIG. 9 is a partial top isometric view of lamp isolators in an uplight configuration.
Figure 10:
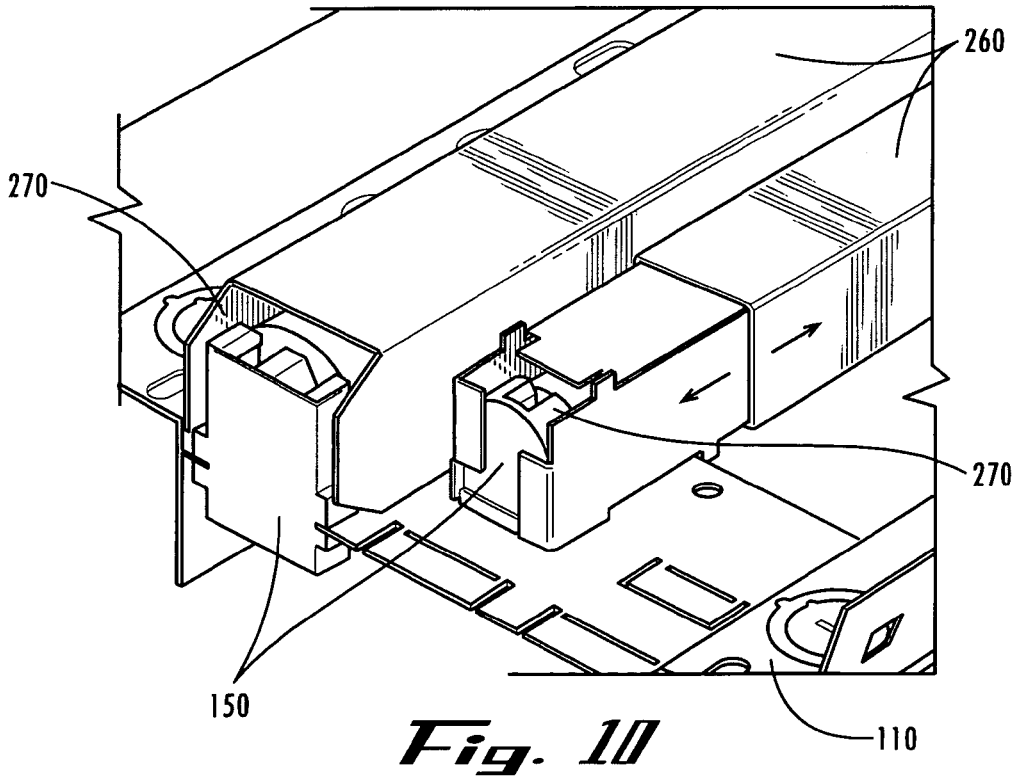
FIG. 10 is a partial top isometric view of lamp isolator in a downlight configuration.

As illustrated in FIGS. 9 and 10, each of the lamps 130 may be further provided with a lamp isolator 260. When the lamp isolators 260 are arranged to open upwardly as shown in FIG. 9, the lamps 130 will provide only uplight. In contrast, when the lamps 130 are provided with isolators that open downwardly as shown in FIG. 10, those lamps will provide only downlight. Each of the lamp isolators 260 is provided with a slot 270 that allows the isolator to be slipped over the socket 150 when the isolator is in the uplight configuration shown in FIG. 9. Each of the lamp isolators 260 may also be formed with nested C-shaped channel members that slide relative to each other so as to accommodate lamps 130 of various lengths.

It should be emphasized that the embodiments described above, and particularly any "preferred" embodiments, are merely examples of various implementations that have been set forth here to provide an understanding of various aspects of the invention. One of ordinary skill will be able to alter many of these embodiments without substantially departing from scope of protection defined solely by the proper construction of the following claims.

What is claimed is:

1. A direct-indirect luminaire, comprising:

a pair of lamp sockets for receiving at least one tubular fluorescent lamp;

a louver, arranged on one side of the lamp sockets, for controlling downlight emitted from a bottom side of the luminaire; and a shutter, arranged on an opposite side of the lamp sockets, for controlling uplight emitted from a top side of the luminaire, wherein the shutter comprises:

a first member comprising a first plurality of apertures disposed longitudinally along the first member; and a second member comprising a second plurality of apertures disposed longitudinally along the second member, the first member positioned adjacent to the second member and slidable relative to the second member;

wherein at least a portion of each of the first plurality of apertures overlaps at least a portion of each of the second plurality of apertures, the overlap creating a light pathway for emitting light through the overlap in the apertures and out of the top side of the luminaire.

2. The luminaire recited in claim 1, wherein the first plurality of apertures and second plurality of apertures comprise matching patterns of overlapping apertures.

3. The luminaire recited in claim 2, wherein the first member and the second member comprise concave surfaces and wherein at least a portion of the second member is nested within the concave surface of the first member.

4. The luminaire recited in claim 3, wherein the concave surfaces are channel-shaped and the apertures are arranged on at least two walls of the channel.

5. The luminaire recited in claim 2, further comprising a positioner for designating a size of the apertures.

6. The luminaire recited in claim 5, wherein the positioner comprises a protuberance on one of the adjacent members for engaging a hole in another of the adjacent members.

7. A direct-indirect lighting system, comprising:

a lamp;

a baffle arranged on one side of the lamp for controlling downlight from the lamp; and a shutter arranged on an opposite side of the lamp;

wherein said shutter comprises:

a first channel-shaped member comprising a first plurality of apertures disposed longitudinally thereon;

a second channel-shaped member comprising a second plurality of apertures disposed longitudinally thereon, the second channel-shaped member disposed within the first channel-shaped member;

wherein the first channel-shaped member is slidable relative to the second channel-shaped member;

wherein at least a portion of each of the first plurality of apertures overlaps at least a portion of each of the second plurality of apertures, the overlap creating a light pathway for emitting light from the lamp, through the overlap of the apertures, and out a top side of the lighting system; and wherein sliding the first channel-shaped member relative to the second channel-shaped member adjusts the overlap of at least a portion of the first plurality of apertures to at least a portion of the second plurality of apertures.

8. The lighting system recited in claim 7, wherein the channel-shaped members comprise adjacent surfaces that are slidable relative to each other.

9. The lighting system recited in claim 7, further comprising a positioner for designating a size of the apertures.

10. The lighting system recited in claim 9, wherein the positioner comprises a protuberance coupled to one of the channel-shaped members for engaging a hole in the other of the channel-shaped members.

11. The lighting system recited in claim 7, wherein said apertures are arranged on at least two walls of each of the first and second channel-shaped members.

12. The luminaire recited in claim 7, wherein the baffle includes a louver grid.

13. A direct-indirect luminaire, comprising:

means for receiving at least one tubular fluorescent lamp;

means, arranged on one side of the lamp receiving means, for controlling downlight from the lamp; and means, arranged on an opposite side of the lamp receiving means for controlling uplight from the lamp comprising:

a first channel-shaped member comprising a first plurality of apertures disposed longitudinally thereon;

a second channel-shaped member comprising a second plurality of apertures disposed longitudinally thereon, the second channel-shaped member adjacent to and nested within the first channel-shaped member;

wherein the channel-shaped members are slidable relative to one-another wherein in a first position at least a portion of each of the first plurality of apertures overlaps at least a portion of each of the second plurality of apertures, the overlap creating a light pathway for emitting light from the lamp out a top side of the luminaire.

14. The luminaire recited in claim 13, wherein, sliding the first channel-shaped member relative to the second channel-shaped member adjusts the overlap of the first and second plurality of apertures and a size of light pathway.

15. The luminaire recited in claim 13, wherein the apertures are arranged on at least two walls of each of the channel-shaped members.

16. The luminaire recited in claim 14, further comprising means for designating the overlap of the apertures.

17. The luminaire recited in claim 16, wherein the means for designating a size of the overlap of the apertures comprises a protuberance on one of the adjacent members for engaging a hole in the other of the adjacent members.

18. The luminaire recited in claim 13, where a pattern of the first plurality of apertures matches a patter of the second plurality of apertures.

19. The luminaire of claim 1, wherein the first member is slidable from a first position to a second position, wherein in the first position at least a portion of each of the first plurality of apertures overlaps at least a portion of a corresponding one of the second plurality of apertures to create a light pathway for emitting light from the top side of the luminaire and wherein in the second position each of the first plurality of apertures does not overlap the corresponding ones of the second plurality of apertures to prevent light from emitting from the top side of the luminaire.

20. The system of claim 7, wherein each of the first plurality of apertures corresponds to one of the second plurality of apertures.

21. The system of claim 7, wherein the first plurality of apertures are disposed along a first plane and the second plurality of apertures are disposed along a second plane, wherein the first plane and the second plane are parallel.

22. The luminaire of claim 1, wherein the first plurality of apertures are disposed along a first plane and the second plurality of apertures are disposed along a second plane, wherein the first plane and the second plane are parallel.

23. The luminaire of claim 1, wherein the first member and the second member are longitudinally aligned with one-another.

* * * * *